US006364749B1

(12) United States Patent
Walker

(10) Patent No.: US 6,364,749 B1
(45) Date of Patent: Apr. 2, 2002

(54) CMP POLISHING PAD WITH HYDROPHILIC SURFACES FOR ENHANCED WETTING

(75) Inventor: Michael A. Walker, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/389,293

(22) Filed: Sep. 2, 1999

(51) Int. Cl.[7] ..... B24B 1/00; B24B 7/00

(52) U.S. Cl. ..... 451/41; 451/56; 451/548; 451/550

(58) Field of Search ..... 451/41, 56, 527, 451/550, 548; 51/298

(56) References Cited

U.S. PATENT DOCUMENTS 4,581,287 A * 4/1986 Smith et al. ..... 451/526
5,007,128 A * 4/1991 Englund et al. ..... 451/526
5,090,540 A 2/1992 Hasegawa et al.
5,162,248 A 11/1992 Dennison et al.
5,185,964 A * 2/1993 Englund et al. ..... 451/526
5,270,241 A 12/1993 Dennison et al.
5,396,737 A * 3/1995 Englund et al. ..... 451/28
5,498,562 A 3/1996 Dennison et al.
5,518,948 A 5/1996 Walker
5,616,069 A 4/1997 Walker et al.
5,645,737 A 7/1997 Robinson et al.
5,652,164 A 7/1997 Dennison et al.
5,690,540 A 11/1997 Elliott et al.
5,733,176 A 3/1998 Robinson et al.
5,779,522 A 7/1998 Walker et al.
5,855,804 A 1/1999 Walker
5,855,811 A 1/1999 Grieger et al.
5,879,222 A 3/1999 Robinson
5,893,754 A 4/1999 Robinson et al.
6,002,268 A * 2/2000 Roberts et al. ..... 451/548
6,022,264 A * 2/2000 Cook et al. ..... 451/527
6,062,968 A * 5/2000 Sevilla et al. ..... 451/526
6,071,178 A * 6/2000 Baker, III ..... 451/36

* cited by examiner

*Primary Examiner*—M. Rachuba
(74) *Attorney, Agent, or Firm*—Knobbe, Martens, Olson & Bear, LLP

(57) ABSTRACT

An improved CMP polishing member having a plurality of protrusions with an outer surface, the outer surface of the protrusions defining a polishing surface of the CMP pad adapted to polish or planarize an exposed surface of a semiconductor wafer. A plurality of cavities are interposed between the protrusions and the cavities have a hydrophilic surface so as to attract wetting solution to thereby enhance retention of the wetting solution adjacent the polishing interface between the surface of the semiconductor wafer and the polishing surface of the polishing pad. In one embodiment, the protrusions are comprised of a fixed abrasive material, such that the polishing pad is a fixed abrasive polishing pad. In one embodiment, the cavities between the protrusions are coated with a hydrophilic material so as to retain wetting solution immediately adjacent the exposed surfaces of the fixed abrasive protrusion. The protrusions can either be in the form of a plurality of discrete protrusions formed on a first surface of a substrate of a semiconductor wafer or, alternatively, can be comprised of a plurality of spiral protrusions.

40 Claims, 5 Drawing Sheets

CM P POLISHING PAD WITH HYDROPHILIC SURFACES FOR ENHANCED WETTING

BACKGROUND OF THE INVENTION

1. Field of the Invention

The present invention relates to semiconductor processing technology and, in particular, concerns a chemical mechanical polishing system which incorporates a chemical mechanical polishing pad, such as a fixed abrasive chemical mechanical pad, having hydrophilic surfaces for enhanced wetting of the semiconductor substrate during the chemical mechanical polishing process.

2. Description of the Related Art

Chemical mechanical polishing or planarization (CMP) is a technique whereby surfaces, such as semiconductor substrates, are planarized by the simultaneous application of both an etching and a polishing process. CMP is typically used to globally planarize surfaces such as the upper surface of a semiconductor wafer. The wafer is typically positioned within a carriage and is rotated with respect to a polishing pad. In one approach, a slurry containing abrasive particles and an etchant is interposed between the polishing pad and the surface of the semiconductor wafer that is to be planarized. The polishing pad is then brought into contact with the surface of the wafer that is to be planarized and the combination of the mechanical polishing and the etchant results in the exposed surfaces of the wafer being removed by the CMP process.

CMP is particularly well-suited for global planarization of wafers having many semiconductor structures, such as DRAM memories, formed thereon. By planarizing the wafer during the fabrication of the semiconductor devices, additional layers can be deposited onto the wafer while utilizing less surface area of the wafer. This allows for the formation of higher density devices and devices that are structurally stronger.

One difficulty that occurs in typical CMP processes is that the abrasive contained within the slurry often flocculates when the slurry is mixed with particular chemicals added to the slurry to enhance particular CMP parameters. The flocculation of the abrasive particles results in a localized increase in concentration of the abrasive particles on particular surface regions of the semiconductor wafer with respect to other regions of the semiconductor wafer. This can result in uneven planarization of the semiconductor wafer and possibly even result in scratching of the wafer and damage to the devices and structures formed on the semiconductor wafer. Moreover, mixing the abrasive particles into the slurry so as to obtain a uniform distribution of the abrasive particles in the slurry during the CMP process can be very complicated and difficult. In particular, premixed abrasive particles may separate prior to introduction to the interface between the polishing pad and the semiconductor wafer or the slurry may clog various jets and orifices in the CMP system resulting in localized differences in the density of the abrasive within the slurry and wafer planarization.

These types of problems have led to the development of CMP systems wherein the abrasive is not encapsulated within the slurry but is actually part of the polishing pad. One such fixed abrasive polishing pad is disclosed in U.S. Pat. No. 5,879,222 which discloses a particular type of polishing pad having abrasive particles captured within the polishing pad. In fixed abrasive polishing pads, the abrasive is encapsulated in the pad and is preferably uniformly distributed over the pad so that the wafer is in contact with a more uniform quantity of abrasive particles during the CMP process. The slurry thus does not contain the abrasive particles and, therefore, uniformity of distribution of the abrasive particles over the surface of the wafer during the CMP process is improved. While currently available fixed abrasive polishing pads solve some of the problems associated with abrasive laden slurry-based CMP processes, many fixed abrasive polishing pads inhibit wetting of the semiconductor substrate that is to be polished.

In particular, it is desirable that there be a sufficient quantity of liquid, such as water, on the surface of a semiconductor wafer that is to be chemically mechanically polished so as to enhance the polishing process. The liquid serves as a lubricant and inhibits the abrasive particles from gouging into the surface being planarized. In the absence of such liquid, abrasives, either from a fixed abrasive polishing pad or abrasive contained within a slurry, can generate localized scratches on the surface of the semiconductor wafer which can result in damage to devices formed on this surface. Further, the absence of the liquid may also result in excessive heat on the surface being planarized causing additional damage to this surface.

One factor which contributes to these problems is that the polishing pads used either for fixed abrasive polishing pads or for standard slurry-based polishing pads are often formed of hydrophobic materials, such as urethane-based materials. Consequently, the water contained within the slurry mixture is not attracted to the portion of the polishing pad that is actually polishing the semiconductor wafer. This results in a potential reduction of wetting of the semiconductor wafer at the point of contact between the polishing pad and the semiconductor wafer. This problem is particularly acute with fixed abrasive polishing pads wherein the fixed abrasive is often captured within a hydrophobic resin such that water is not attracted to the polishing interface.

It will be appreciated that the problem of localized damage or scratching to semiconductor surfaces becomes a much greater problem as the scale of integration of the integrated circuits formed on the semiconductor wafer increases. As the scale of integration increases, the devices are formed much smaller such that a small scratch may damage one or more devices. In very large scale or ultra large scale applications, even very small scratches in the semiconductor surface can result in damage to the underlying devices. As a consequence, the hydrophobic nature of many prior art CMP polishing pads, including both slurry-type pads and fixed abrasive pads, that inhibit wetting at the polishing interface, can significantly affect yield during device formation.

Hence, there is a need for a chemical mechanical polishing pad that is adapted to reduce damage to the semiconductor wafer as a result of reduced wetting at the interface between the polishing pad and the surface of the semiconductor wafer being polished. To this end, there is a need for a CMP pad, which can either be a fixed abrasive pad or a slurry-based polishing pad, that provides for greater wetting of the surface at the interface between the pad and the surface being planarized.

SUMMARY OF THE INVENTION

The aforementioned needs are satisfied by the CMP member of the present invention which is comprised of a substrate and a plurality of polishing protrusions extending from a first surface of the substrate. The plurality of polishing protrusions are adapted to polish and remove an exposed surface of a semiconductor wafer during a CMP process.

The first surface of the substrate is hydrophilic so as to retain wetting fluid adjacent the protrusion such that the wetting fluid is retained at the interface between the polishing protrusions and the semiconductor wafer.

In one aspect of the invention, a CMP polishing member is provided which is comprised of a substrate having a plurality of protrusions extending from the substrate wherein the plurality of protrusions contain a fixed abrasive that is encapsulated therein. The first surface of the substrate includes a hydrophilic material so as to attract and retain water adjacent the fixed abrasive protrusions during the polishing process to thereby enhance wetting of the semiconductor surface during a CMP process. In one embodiment, the protrusions are comprised of a plurality of discrete protrusions positioned about the polishing member. In another embodiment, the protrusions are comprised of a plurality of spiral wedges separated by grooves wherein the hydrophilic material is positioned within the grooves.

In another aspect of the invention, a CMP polishing pad having a substrate and a plurality of fixed abrasive protrusions is provided. The fixed abrasive protrusions and the polishing pad are coated with a hydrophilic material that is removed from a distal portion of the fixed abrasive protrusions so as to expose the fixed abrasive to a surface of a semiconductor wafer that is to be chemically mechanically planarized. The hydrophilic coating is adapted to retain wetting fluid adjacent the exposed fixed abrasive surface of the protrusions to thereby enhance wetting of the semiconductor surface during the CMP process.

It will be appreciated that the CMP polishing member of the present invention enhances wetting of the semiconductor surface during the CMP process in both fixed abrasive CMP pad systems and slurry-based nonabrasive CMP pad systems. These and other objects and advantages of the present invention will become more fully apparent from the following description taken in conjunction with the accompanying drawings.

DETAILED DESCRIPTION OF THE PREFERRED EMBODIMENT

Figure 1A:
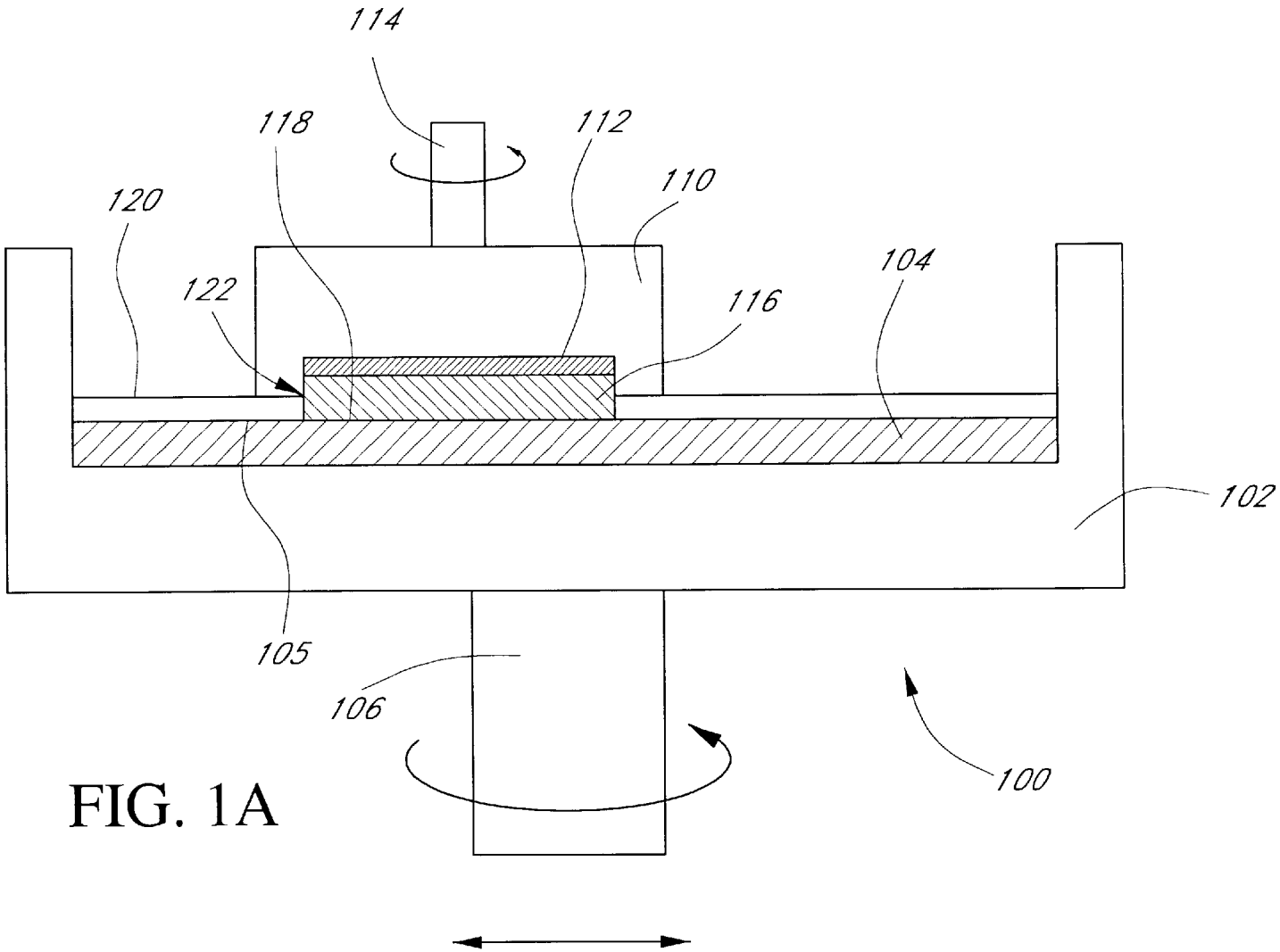
FIG. 1A is a schematic illustration illustrating one embodiment of a chemical mechanical polishing (CMP) system.

Reference will now be made to the drawings wherein like numerals refer to like parts throughout. Referring initially to FIG. 1A, an exemplary chemical mechanical polishing (CMP) system 100 is illustrated. In particular, the CMP system 100 includes a platen 102 that is rotated about a shaft 106 by a motor (not shown). The platen 102 retains a polishing pad 104 of a type that will be described in greater detail below in reference to FIGS. 2–5. The CMP system also includes a carriage 110 that has a wafer receiving surface 112 which is adapted to retain a wafer 116 within the carriage 110. The carriage is also adapted to be rotated about a shaft 114 by a motor (not shown).

The operation of the CMP system 100 is similar to the operation of similar CMP systems of the prior art. Basically, the platen 102 is rotated and the carriage 110 is rotated such that rotational movement between the silicon wafer 116 and the polishing pad 104 is imposed. The platen 102 and the carriage 110 are then moved together such that an exposed surface 118 of the wafer 116 is brought into contact with an outer surface 105 of the polishing pad 104. A wetting solution or slurry 120 is provided to the outer surface 105 of the polishing pad 104 so as to wet the interface 122 between the outer surface 105 of the polishing pad 104 and the exposed surface 118 of the wafer 116 to thereby enhance the polishing and removal of the surface 118 of the wafer 116. It will be appreciated that the CMP system 100 illustrated in FIG. 1 is simply exemplary of any of a number of well known CMP systems currently used in semiconductor fabrication and processing. The single platen 102 could be one of a number of platens in a more sophisticated system without departing from the spirit of the present invention.

As is understood in the art, the combined effects of the pad 104 frictionally engaging with the exposed surface 118 of the wafer 116 and the existence of etchants in the wetting solution or slurry 120 results in the systematic removal of layers of the exposed surface 118 of the wafer 116. It will be appreciated from the following description that the CMP system 100 incorporating the improved polishing pad 104 of the preferred embodiments can be comprised of a CMP system where an abrasive is provided to the wetting fluid 120 to thereby form a well-known slurry or can be used in connection with polishing pads 104 wherein the abrasive is encapsulated in the polishing pad 104 itself.

Figure 1B:
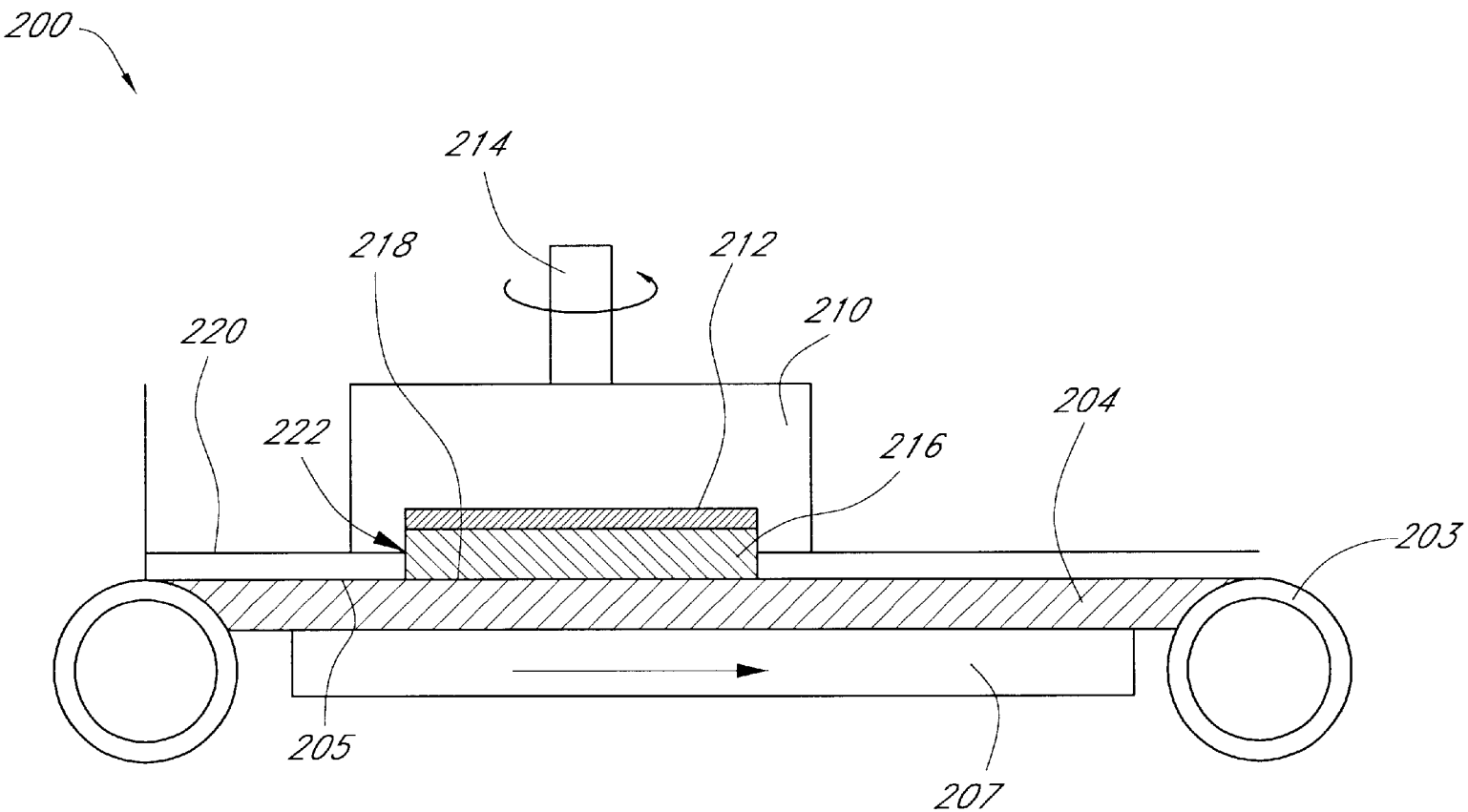
FIG. 1B is a schematic illustration of another embodiment of a chemical mechanical polishing system.

FIG. 1B schematically illustrates another typical embodiment of a CMP system 200. The system 200 is a fixed abrasive CMP system of a type well known in the art. In the system 200, a fixed abrasive web 204 extends between two rollers 203. The fixed abrasive web 204 travels over a fixed platform 207 in the proximity of a carriage 210 that is adapted to receive a wafer 116 on a wafer receiving surface 212 in a manner known in the art. The carriage 210 is orbitally rotated and moved over the portion of the fixed abrasive web 104 positioned on the platform 207 by a motor (not shown ) attached to a shaft 214. The fixed abrasive web 204 preferably includes fixed abrasive materials such that the orbital movement of the carriage 210 over the web 204 results in planarization of the surface 218 of the wafer 216 in a manner known in the art. A wetting solution 220 may be optionally used to wet the interface 222 between the web 204 and the wafer 216. It will be appreciated from the following discussion that the fixed abrasive web 204 can be configured to enhance wetting in the same manner as the pads 104.

As will also be apparent from the following description, it is desirable to retain a wetting solution adjacent the interface between the wafer surface and the polishing pad or web so as to reduce the damage to the outer surface of the wafer during the polishing process using either a slurry CMP system 100 or a fixed abrasive web CMP system 200. Moreover, as discussed above, retaining the wetting solution adjacent the outer surface of the wafer is often complicated as a result of the polishing pad 104 or the polishing web 204 being made of a hydrophobic material, such as polyurethane, which reduces the tendency of water to stay adjacent the interface.

Figure 2A:
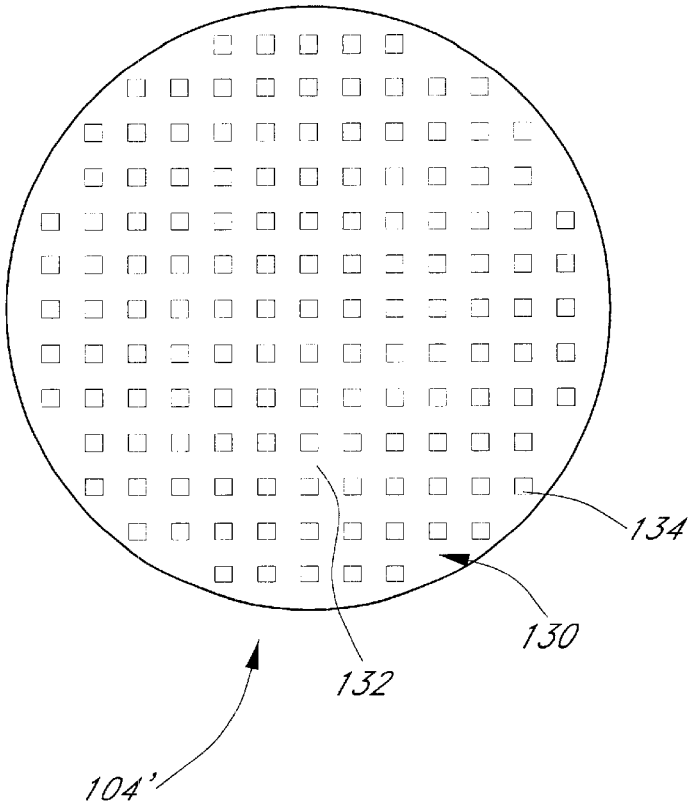
FIG. 2A is a plan view of one embodiment of a chemical mechanical polishing pad used in conjunction with the CMP system of FIG. 1A.

FIG. 2A is a top view illustration of a first embodiment of a CMP pad 104' that is adapted to retain fluid adjacent the interface 122 (FIG. 1A) between the polishing pad surface 105 and the surface 118 of the wafer 116. As illustrated in FIG. 2A, the CMP pad 104' includes a substrate 130 with a plurality of protrusions 134 extending outward from a first surface 132 of the substrate 130. In this embodiment, the surface 132 includes hydrophilic material so as to retain wetting solution adjacent the surface 132 during the CMP process. The protrusions 134 define the polishing surface 105 of the pad 104 (FIG. 1) that will polish or planarize the outer surface 118 of the wafer 116. In one embodiment, the plurality of protrusions 134 can be formed of a fixed abrasive structure. For example, the fixed abrasive protrusions can consist of abrasive particles, such as silica, alumina, and the like, encapsulated within a resin, such as a urethane-based resin. In this embodiment, the fixed abrasive protrusions 134 provide the abrasive that will polish the outer surface 118 of the semiconductor wafer 116.

As is further illustrated in FIG. 2, the majority of the surface area of the surface 132 of the polishing pad 104' is comprised of a recess which is adapted to be hydrophilic. As will be discussed in greater detail below, the substrate 130 itself can either be formed of any of a number of well-known hydrophilic materials or can be coated with a similar hydrophilic material. Preferably, between 70% and 94% of the surface 132 is hydrophilic with 6% to 30% of the surface being comprised of the protrusions 134 defining the polishing surface 105 of the polishing pad 104'. In one embodiment, the protrusions 134 define approximately 10% of the surface area of the surface 132 of the polishing pad 104' and the protrusions 134 extend approximately 60 to 90 mils from the surface 132 of the substrate 130. It will be appreciated that the protrusions 134 are formed so as to extend a uniform height from the surface 132 such that the polishing of the semiconductor wafer 116 is substantially uniformly performed by a planar polishing surface 105 defined by the protrusions 134.

Figure 2B:
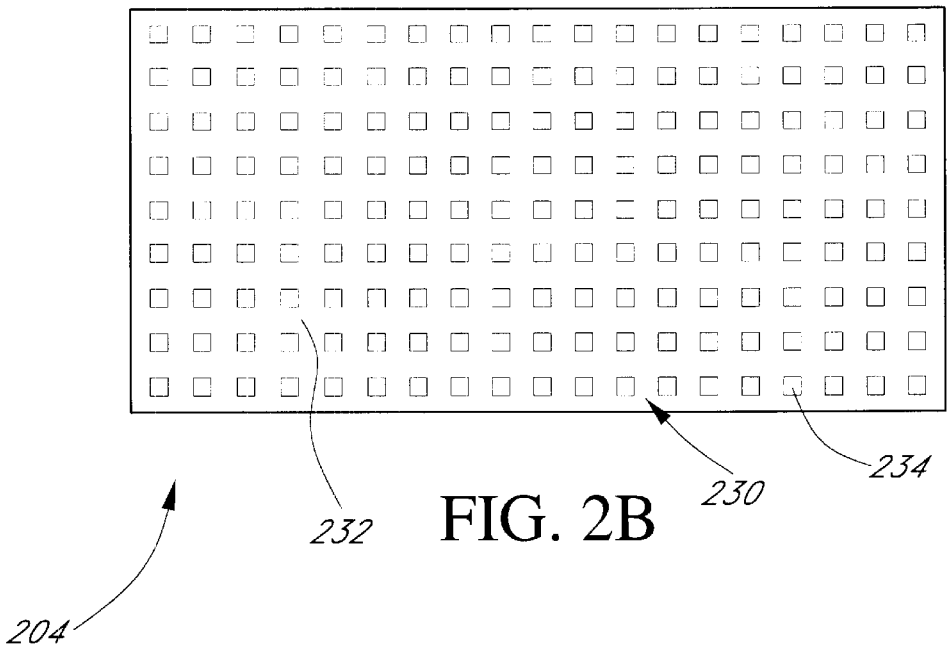
FIG. 2B is a plan view of an embodiment of a CMP web used in the CMP system of FIG. 1B.

As discussed above, the CMP system may be comprised of a web-type fixed abrasive system 200 such as the system schematically illustrated in FIG. 1B. As illustrated in FIG. 2B, instead of a pad 104, this system uses a web 204 having a flexible substrate 232 of a type known in the art. The substrate 232 is either formed of a hydrophilic material or is coated with a hydrophilic material. In this embodiment, a plurality of protrusions 234 can be formed on the substrate 232 in a similar manner as described above in connection with FIG. 2A. The protrusions 234 encapsulate the fixed abrasive material such that orbital rotation of the wafer 216 over the web 204 results in chemical mechanical planarization of the wafer 216 in a substantially similar manner as discussed above in connection with FIG. 2A.

Figure 3:
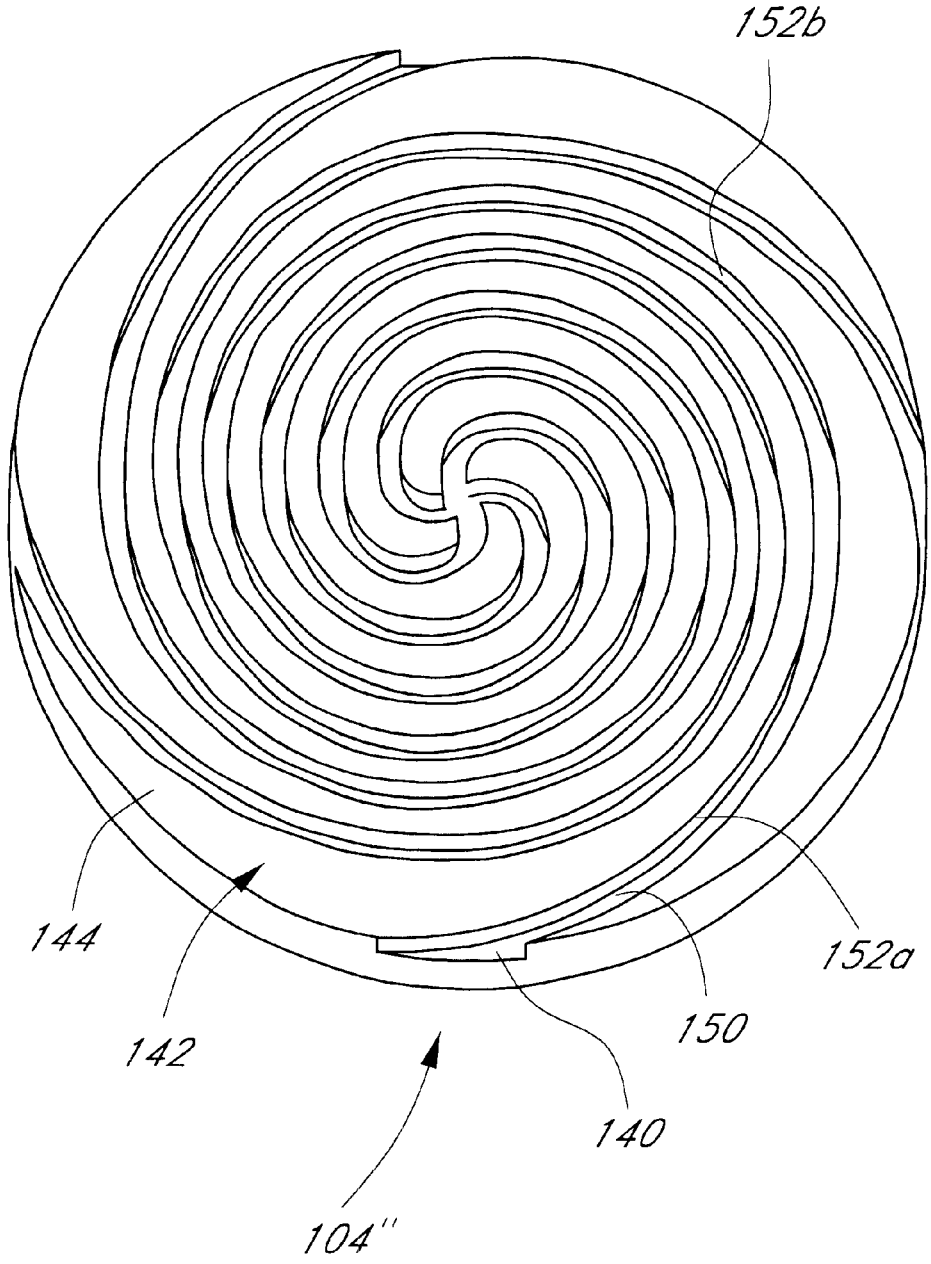
FIG. 3 is a plan view of another embodiment of a CMP pad used in conjunction with the CMP system of FIG. 1A.

FIG. 3 is an alternate embodiment of a polishing pad 104" that is adapted to polish or planarize the exposed surface 118 of the wafer 116 in the above described manner. As illustrated in FIG. 3, the polishing pad 104" has a plurality of grooves or channels 140 formed in a first surface 142 of the polishing pad 104". Hence, a plurality of protrusions 144 are defined on the first surface 142 of the polishing pad 104". In the illustrated embodiment, the grooves 140 are spiral in shape thereby resulting in spiral shaped protrusions 144. However, it will be appreciated that the exact configuration of the protrusions and the grooves need not be spiral and can, in fact, be any of a number of possible shapes without departing from the spirit of the present invention.

The plurality of spiral protrusions are preferably formed of a material that will allow polishing or planarization of the exposed surface 118 of the wafer 116 in a manner that is known in the art. The protrusions 144 may either comprise a fixed abrasive structure similar to the structures described previously with respect to FIG. 2 or may be formed of a material that is suitable for standard slurry-based CMP processes.

These grooves 140 preferably have a bottom surface 150 and side wall surfaces 152*a*, 152*b* that are preferably coated or formed from a hydrophilic material. In this way, the spiral protrusions 144 define the polishing surface 105 of the pad 104" and can engage in planarization of the outer surface 118 of the wafer 116 in a well-known manner with the wetting solution being retained in the grooves 140 by the hydrophilic material. This ensures that the wetting solution will be better maintained in proximity to the interface 122 (FIG. 1) between the polishing surface 105 of the polishing pad 104 and the exposed surface 118 of the semiconductor wafer 116.

From the foregoing, it will be appreciated that the pads 104' and 104" and the web 204 are adapted to include hydrophilic surfaces or regions which are configured to retain wetting solution adjacent a polishing surface defined by the protrusions 134, 144 or 234. Retaining the wetting solution in proximity to the polishing surfaces of the polishing pads enhances the wetting of the interface between the polishing pad or web and the wafer surface during the CMP process. Enhanced wetting during the CMP process reduces the tendency of the surface of the wafer to be damaged during the CMP process as it allows for removal of abrasives, reduces the tendency of the abrasives to flocculate and provides lubrication at the polishing interface. This reduces the likelihood of the surface of the semiconductor wafer being unduly damaged as a result of the CMP process.

Figure 4:
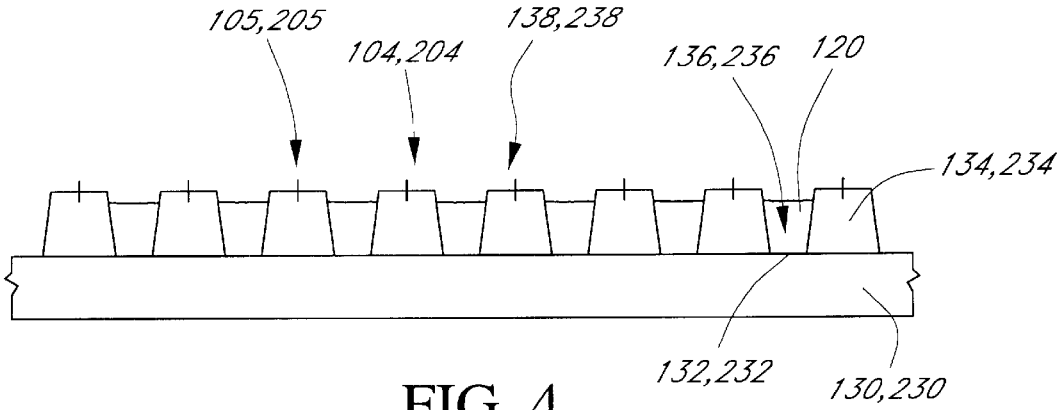
FIG. 4 is a side view illustrating one embodiment of a CMP pad used in conjunction with the CMP system of FIG. 1A.

FIG. 4 is a side cross-sectional view of a polishing pad 104 or web 204 that is similar to the polishing pad 104' illustrated in FIG. 2A or the web 204 illustrated in FIG. 2B. FIG. 4 illustrates that the polishing pad 104 or web 204 has a substrate 130 with a plurality of protrusions 134 extending upwardly from the first surface 132 of the polishing pad 104. In this embodiment, the substrate 130 is hydrophilic, and the protrusions 134 are comprised of a urethane-cake material, which includes abrasives, such as silica or alumina, so that the polishing pad 104 or web defines a fixed abrasive polishing pad. As illustrated in FIG. 4, during operation the wetting solution 120 fills the cavities 136 between the protrusions 134. Having the substrate 130 being made of a hydrophilic material results in the wetting solution 120 being attracted to and retained in the cavities 136. By retaining the wetting solution 120 in the cavities 136, the wetting solution 120 is maintained in proximity to the polishing surface 105 defined by the outer surfaces of the protrusions 134. It will be appreciated that during the CMP process, the fixed abrasive protrusions 134 will be diminished as fixed abrasive is rubbed off of the protrusions while polishing or planarizing the wafer 116. However, the wetting solution 120 will generally be retained adjacent the polishing surface 105 defined by the protrusions 134 during the polishing process.

Figure 5A:
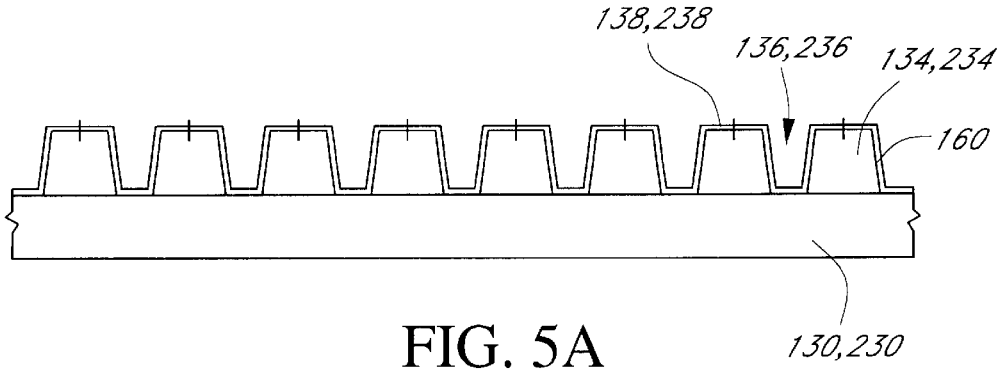
FIGS. 5A–5C are side views illustrating another embodiment of a CMP polishing pad used in conjunction with the CMP system of FIG. 1.
Figure 5B:
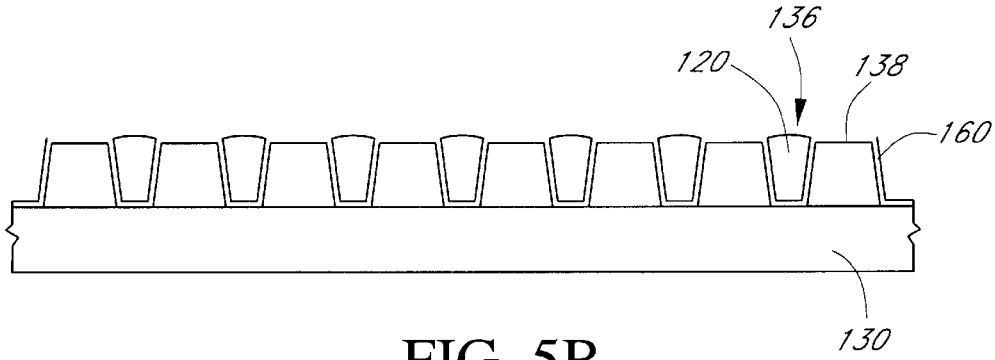
Figure 5C:
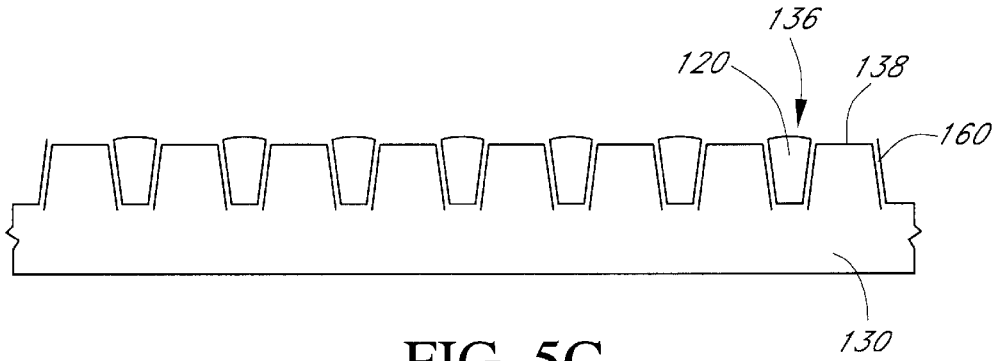

FIGS. 5A–5C are cross-sections which illustrate other embodiments of a CMP member or surface such as a polishing pad 104 or a web 204. In this embodiment, a well-known fixed abrasive polishing pad or web having a plurality of protrusions 134 is coated with a hydrophilic coating 160. The polishing pad or web 104, 204 includes a substrate 130 and a plurality of protrusions 134 extending outwardly therefrom. In one embodiment, the protrusions 134 preferably include a fixed abrasive material encapsulated within a resin and, in this embodiment, is similar to the structure of the polishing pad 104' or web 204 described above in conjunction with FIGS. 2A and 2B. A hydrophilic coating 160 is coated over the first surface 132 of the polishing pad 104 or web 204 and the outer surfaces of the protrusions 134. In particular, the coating 160 is approximately 0.1–15 mils thick and coats the outer surface 138 of the protrusions 134 and the side surfaces 139 of the protrusions 134, 234 as well.

During operation, the polishing process removes the coating 160 from the outer surface 138 of the protrusions 134 thereby revealing the outer surfaces 138 to allow for the fixed abrasive encapsulated within the protrusions 134 to polish and planarize the surface 118 of the wafer 116. However, as shown in FIG. 5B, while the outer surfaces 138 are exposed to allow for planarization of the wafer, the hydrophilic coating material is retained on the side walls 139 and on the surface 132 of the substrate 130 of the polishing pad 104 or web 204. This retains the wetting solution 120 in the cavities 136 between each of the protrusions 134 and thereby retains the wetting solution in close proximity to the polishing surface 105 defined by the outer ends of each of the protrusions 134. As the protrusions 134 are reduced in size during the polishing process, the hydrophilic coating 160 on the side walls 139 is similarly reduced, however, the wetting solution 120 generally is maintained in close proximity to the outer surface 138 of the protrusions 134.

As illustrated in FIG. 5C, the pad 104 or web 204 can also be made of a single solid substrate 130 with cavities 136 formed in an outer surface that is coated with hydrophilic material. In this embodiment, the substrate 130 and the protrusions 134 defined by the cavities 136 are formed of a fixed abrasive material and the hydrophilic coating retains the wetting solution adjacent the polishing surface defined by the protrusions.

In the embodiments illustrated in FIGS. 4 and 5, the wetting solution 120 is preferably retained immediately adjacent the polishing interface 122 so as to reduce the likelihood of damage to the outer surface 118 of the wafer 116 during the planarization process. While the embodiments of FIGS. 4 and 5 have illustrated the retention of the wetting solution 120 in the context of the polishing pad 104 with a plurality of discrete protrusions, it will be appreciated that these same formation techniques can be used to form a CMP polishing pad having grooves similar to the polishing pad described in connection with the embodiment illustrated in FIG. 3. In particular, the embodiment of FIG. 3 can either have a hydrophilic substrate with the spiral protrusions 144 extending outwardly therefrom or can be preformed and then have a hydrophilic coating 160 coating each of the protrusions 144 and the grooves 140. While the embodiments discussed in connection with FIGS. 4 and 5 describe fixed abrasive polishing pads or webs, the hydrophilic configuration of the cavities 136 can also be used in connection with non-fixed abrasive polishing pads to enhance wetting retention in these applications without departing from the spirit of the present invention.

It will be appreciated that any of a number of coatings or materials can be used to formed the hydrophilic surface that retains the liquid adjacent the polishing surfaces. In one embodiment, the polishing member, either a pad 104 or a web 204, can be made of a resin that when locally oxidized, forms a hydrophilic surface. Such oxidation can be accomplished using an $O_2$ plasma etch.

From the foregoing, it will be appreciated that the embodiments of the present invention disclose a polishing pad suitable for use for CMP that has an increased capability of retaining wetting solution adjacent the polishing interface between the wafer and the polishing pad. Further, the polishing pads or webs of the disclosed embodiments are suitable for use with fixed abrasive-type polishing pads or webs wherein a plurality of cavities are formed adjacent protrusions having the fixed abrasive encapsulated therein and wherein the cavities are configured so as to enhance retention of wetting solution adjacent the polishing surfaces of the fixed abrasive polishing protrusions. Further, the polishing pads or webs disclosed herein also comprise polishing pads or webs having non-fixed abrasive protrusions with polishing protrusions with cavities interposed therebetween. These cavities can be similarly hydrophilically coated or formed to enhance wetting at the polishing interface.

Although the preferred embodiments of the present invention have shown, described and pointed out the fundamental novel features of the invention, as applied to these embodiments, it will be understood that various omissions, substitutions and changes in the form of the detail of the device illustrated may be made by those skilled in the art without departing from the spirit of the present invention. Consequently, the scope of the invention should not be limited to the foregoing description, but should be defined by the appended claims.

What is claimed is:

1. A chemical mechanical polishing surface for chemically mechanically polishing a semiconductor surface comprising:

a substrate having a first surface;

a plurality of protrusions extending from the first surface of the substrate so as to extend a selected distance from the substrate, wherein the plurality of protrusions define a polishing surface that engages with the semiconductor wafer so as to chemically mechanically polish the semiconductor wafer and wherein the protrusions define cavities being positioned therebetween and wherein each cavity has a plurality of side surfaces and a bottom surface wherein the side surfaces and the bottom surface of the cavities comprise exposed hydrophilic surfaces that attract liquid into the cavities adjacent the polishing surface defined by the plurality of protrusions so as to facilitate liquid flow through the cavities and increase the wetting of a semiconductor surface during chemical mechanical polishing.

2. The polishing surface of claim 1, wherein the plurality of protrusions comprise a plurality of discrete protrusions distributed across the first surface of the substrate and having cavities positioned between each adjacent protrusion.

3. The polishing surface of claim 2, wherein the plurality of protrusions occupy between approximately 6 and 30 percent of the first surface of the substrate.

4. The polishing surface of claim 3, wherein the plurality of protrusions occupy approximately 10 percent of the first surface of the substrate.

5. The polishing surface of claim 3, wherein the plurality of protrusions extend between approximately 60 and 90 mils from the first surface of the substrate.

6. The polishing surface of claim 1, wherein the plurality of protrusions comprise protrusions that are separated by a plurality of channels.

7. The polishing surface of claim 6, wherein the channels and protrusions are spiral shaped and wherein the channels define the cavities positioned between the plurality of protrusions and have the exposed hydrophilic surfaces for attracting and retaining wetting solution adjacent the polishing surfaces defined by the plurality of protrusions.

8. The polishing surface of claim 1, wherein the plurality of protrusions are formed of a fixed abrasive material so that the abrasive of the chemical mechanical process performed on the semiconductor wafer is provided by the fixed abrasive material.

9. The polishing surface of claim 8, wherein the plurality of protrusions is comprised of protrusions having an abrasive encapsulated within a hydrophobic resin.

10. The polishing surface of claim 9, wherein the plurality of protrusions is comprised of protrusions formed of a silica abrasive encapsulated within a urethane resin.

11. The polishing surface of claim 8, wherein the substrate is formed of a hydrophilic material so that the bottom surface of the cavity interposed between the plurality of protrusions is hydrophilic.

12. The polishing surface of claim 8, wherein the plurality of protrusions and the first surface of the substrate is substantially covered by a hydrophilic coating wherein an outer surface of each of the fixed abrasive protrusions is exposed so as to permit chemical mechanical polishing and wherein the hydrophilic coating is retained in the cavities adjacent the exposed fixed abrasive protrusion so as to increase the wetting of the polishing surface during chemical mechanical polishing of the semiconductor surface.

13. A system for performing chemical mechanical planarization of a semiconductor wafer comprising:

a carriage for retaining a semiconductor wafer;

a polishing surface that is movable with respect to the wafer so that the polishing surface contacts the semiconductor wafer at an interface while moving with respect to the wafer to thereby remove portions of the semiconductor wafer through chemical mechanical polishing at the interface wherein the polishing surface defines a contact surface adapted to polish a surface of the wafer and has at least one cavity which is adapted to retain wetting solution wherein the cavity has a plurality of side surfaces and a bottom surface such that the side surfaces and the bottom surface of the cavities comprise exposed hydrophilic surfaces that attract liquid into the cavity so that wetting of the interface between the polishing surface and the semiconductor wafer is increased during the chemical mechanical polishing of the semiconductor wafer.

14. The system of claim 13, wherein the contact surface is comprised of an outer end of a plurality of discrete protrusions distributed across the first surface of the substrate and having the at least one cavity positioned between each adjacent protrusion.

15. The system of claim 14, wherein the plurality of protrusions occupy between approximately 6 and 30 percent of the first surface of the substrate.

16. The system of claim 15, wherein the plurality of protrusions occupy approximately 10 percent of the first surface of the substrate.

17. The system of claim 16, wherein the plurality of protrusions extend between approximately 60 and 90 mils from the first surface of the substrate.

18. The system of claim 13, wherein the plurality of protrusions comprise spiral shaped protrusions that are separated by a plurality of spiral shaped channels.

19. The system of claim 18, wherein the spiral shaped channels define the cavities positioned between the plurality of protrusions and have the exposed hydrophilic surfaces for attracting and retaining wetting solution adjacent the polishing surfaces defined by the plurality of protrusions.

20. The system of claim 13, wherein the contact surface of the pad is comprised of a plurality of fixed abrasive protrusions so that the abrasive of the chemical mechanical process performed on the semiconductor wafer is provided by the fixed abrasive material.

21. The system of claim 20, wherein the plurality of protrusions is comprised of protrusions having an abrasive encapsulated within a hydrophobic resin.

22. The system of claim 21, wherein the plurality of protrusions is comprised of protrusions formed of a silica abrasive encapsulated within a urethane resin.

23. The system of claim 13, wherein the polishing surface comprises a polishing pad.

24. The system of claim 13, wherein the polishing surface comprises a fixed abrasive polishing web.

25. A method of forming a polishing surface for chemically mechanically polishing a semiconductor wafer comprising:

forming at least one indentation in a surface of a polishing substrate so as to define a plurality of raised polishing surfaces; and configuring the at least one indentation to be hydrophilic so that wetting fluid is retained adjacent the polishing surfaces during chemical mechanical polishing.

26. The method of claim 25, wherein forming the at least one indentation in a surface of a polishing substrate comprises forming a plurality of protrusions on a first surface of a substrate so as to define a plurality of protrusions extending outward therefrom.

27. The method of claim 26, wherein forming the plurality of protrusions comprises forming a plurality of protrusions out of a fixed abrasive material encapsulated within a resin.

28. The method of claim 27, wherein configuring the at least one indentation to be hydrophilic comprises forming the protrusions on a hydrophilic substrate.

29. The method of claim 25, wherein configuring the at least one indentation comprises coating the indentation with a hydrophilic coating.

30. The method of claim 29, wherein coating the indentation with a hydrophilic coating comprises coating the indentation and the side walls of the indentation extending upwards toward the polishing surfaces with a hydrophilic coating.

31. The method of claim 23, wherein configuring the at least one indentation to be hydrophilic comprises oxidizing the material forming the walls of the at least one indentation so as to make the walls hydrophilic.

32. A fixed abrasive polishing member for chemically mechanically polishing a semiconductor device comprising:

a substrate having a first surface; and a plurality of protrusions extending upward from the first surface of the substrate so as to define a polishing surface and so as to define cavities between the plurality of protrusions, wherein the plurality of protrusions are formed of a fixed abrasive material encapsulated within a resin and wherein each cavity has a side surface and a bottom surface that are hydrophilic so as to retain wetting fluid inside the cavity and facilitate fluid flow through the cavity adjacent the polishing surface during chemical mechanical polishing of the semiconductor device.

33. The polishing member of claim 32, wherein the plurality of protrusions comprise a plurality of discrete protrusions uniformly distributed across the first surface of the substrate.

34. The polishing member of claim 33, wherein the plurality of protrusions occupy approximately 10 percent of the surface area of the first surface of the substrate.

35. The polishing member of claim 34, wherein the plurality of protrusions are comprised of an abrasive encapsulated within a hydrophobic resin.

36. The polishing member of claim 35, wherein the plurality of protrusions is comprised of protrusions formed of a silica abrasive encapsulated within a hydrophobic resin.

37. The polishing member of claim 32, wherein the protrusions and the first surface of the substrate is substantially covered by a hydrophilic coating and wherein an outer surface of each of the fixed abrasive protrusions is exposed so as to permit chemical mechanical polishing and wherein the hydrophilic coating is retained in the cavities adjacent the exposed fixed abrasive protrusions so as to increase the wetting of the polishing surface during chemical mechanical polishing of the semiconductor device.

38. The polishing member of claim 32, wherein the plurality of protrusions comprise protrusions separated by channels.

39. The polishing member of claim 38, wherein the plurality of protrusions comprise spiral shaped protrusions that are separated by plurality of spiral shaped channels.

40. The polishing member of claim 39, wherein the spiral shaped channels define the cavities positioned between the plurality of protrusions and have exposed hydrophilic surfaces for attracting and retaining wetting solution adjacent the polishing surfaces defined by the plurality of protrusions.

* * * * *